US008909118B2

(12) United States Patent
Seol et al.

(10) Patent No.: US 8,909,118 B2
(45) Date of Patent: Dec. 9, 2014

(54) FUSING DEVICE AND IMAGE FORMING DEVICE COMPRISING THE SAME

(71) Applicant: Samsung Electronics Co., Ltd, Suwon-si (KR)

(72) Inventors: Dong Jin Seol, Suwon-si (KR); Hwan Hee Kim, Hwaseong-si (KR); Su Ho Shin, Seoul (KR); Dong Woo Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 102 days.

(21) Appl. No.: 13/783,950

(22) Filed: Mar. 4, 2013

(65) Prior Publication Data

US 2014/0199100 A1 Jul. 17, 2014

(30) Foreign Application Priority Data

Jan. 16, 2013 (KR) ..... 10-2013-0005089

(51) Int. Cl.
*G03G 15/20* (2006.01)

(52) U.S. Cl.
CPC ..... *G03G 15/2089* (2013.01)
USPC ..... 399/329

(58) Field of Classification Search
CPC ..... G03G 15/2089
USPC ..... 399/329
See application file for complete search history.

(56) References Cited

U.S. PATENT DOCUMENTS

| | | | | |
|---|---|---|---|---|
| 8,150,305 | B2 * | 4/2012 | Shin | 399/329 |
| 8,204,421 | B2 * | 6/2012 | Hiraoka et al. | 399/329 |
| 2008/0069611 | A1 * | 3/2008 | Obata et al. | 399/331 |
| 2010/0150621 | A1 * | 6/2010 | Sugaya | 399/328 |
| 2011/0200369 | A1 * | 8/2011 | Shinshi | 399/329 |
| 2012/0008971 | A1 * | 1/2012 | Lee et al. | 399/69 |

* cited by examiner

*Primary Examiner* — Sandra Brase
(74) *Attorney, Agent, or Firm* — Staas & Halsey LLP

(57) ABSTRACT

A fusing device with improved fusing performance to obtain superior gloss and gloss uniformity. The fusing device includes at least one heat source to generate heat, a fusing belt disposed near the heat source, a rotation unit contacting an outer circumference of the fusing belt, at least one pressurization unit pressed toward the rotation unit such that a fusing nip is formed between the fusing belt and the rotation unit, a heat conductor contacting an inner surface of the fusing belt to conduct heat to the fusing nip, and an intermediate unit disposed between the pressurization unit and the heat conductor to prevent transmission of heat from the heat conductor to the pressurization unit.

18 Claims, 11 Drawing Sheets

FUSING DEVICE AND IMAGE FORMING DEVICE COMPRISING THE SAME

CROSS-REFERENCE TO RELATED APPLICATIONS

This application claims the benefit of Korean Patent Application No. 2013-0005089, filed on Jan. 16, 2013 in the Korean Intellectual Property Office, the disclosure of which is incorporated herein by reference.

BACKGROUND OF THE INVENTION

1. Field of the Invention

Embodiments of the present inventive concept relate to a fusing device to fix an image on a print medium and an image forming device including the fusing device.

2. Description of the Related Art

An image forming device prints an image on a print medium and includes printers, copiers, facsimiles, multifunction copiers in which functions thereof are integrated and the like.

An image forming device utilizing electrophotography irradiates light to a photosensitive material charged with a predetermined voltage to form an electrostatic latent image on the surface of the photosensitive material and then supplies a toner to the electrostatic latent image to form a visible image. The visible image formed on the photosensitive material is directly transferred to a print medium or is indirectly transferred to the print medium through an intermediate transfer unit, and the visible image transferred to the print medium is fixed on the print medium while passing through the fusing device.

In general, a fusing device includes a heater including a heat source, a roller, a belt or the like and a pressurization unit contacting the heater and thus forming a fusing nip. When the toner image-transferred print medium is inserted between the heater and the pressurization unit, a toner image is fixed on the print medium through heat transmitted from the heater and a pressure applied to the fusing nip.

Gloss and gloss uniformity of the toner image-fixed print medium are major factors determining qualities of image printed to the print medium. In order to obtain superior gloss and gloss uniformity, application of high fusing pressure near the fusing nip formed between the heater and the pressurization unit, and width uniformity of the fusing nip are required.

SUMMARY OF THE INVENTION

The present inventive concept provides a fusing device, fusing performance of which is improved to obtain superior gloss and gloss uniformity, and an image forming device including the same.

Additional features and utilities of the present general inventive concept will be set forth in part in the description which follows and, in part, will be obvious from the description, or may be learned by practice of the general inventive concept.

Exemplary embodiments of the present inventive concept provide a fusing device which includes: at least one heat source to generate heat; a fusing belt disposed near the heat source; a rotation unit to contact an outer circumference of the fusing belt; at least one pressurization unit to press toward the rotation unit such that a fusing nip is formed between the fusing belt and the rotation unit; a heat conductor contacting an inner surface of the fusing belt to conduct heat to the fusing nip; and an intermediate unit disposed between the pressurization unit and the heat conductor to prevent transmission of heat from the heat conductor to the pressurization unit, wherein a difference in height CRN_M between a central part of the intermediate unit and each of both ends of the intermediate unit satisfies the following equation:

$$\delta 1+\delta 2 \leq CRN_M \leq \delta 1+\delta 2+CRN_R$$

wherein $\delta 1$ represents a flexural level of each of both ends of the pressurization unit, when a pressure is applied to the pressurization unit; $\delta 2$ represents a flexural level of each of both ends of the rotation unit, when a pressure is applied to the pressurization unit; and CRN_R represents R2−R1 indicating a difference between a distance R1 between the rotation center of the rotation unit and the central part of the rotation unit, and a distance R2 between the rotation center of the rotation unit and the end of the rotation unit.

A cross-sectional profile of the intermediate unit in a width direction of the intermediate unit may be curved toward the pressurization unit.

The pressurization unit may include: a first pressurization unit having an arch-shaped cross-section; and a second pressurization unit having a reverse arch-shaped cross-section.

At least part of the first pressurization unit may be present inside the second pressurization unit.

The rotation unit may include: a rotatably disposed shaft; and an elastic layer coupled to an outer circumference of the shaft, the elastic layer having an elasticity enabling formation of the fusing nip, when a pressure is applied to the pressurization unit.

The elastic layer may have an ASKER-C hardness of about 50 to about 80.

The elastic layer may have a thickness of about 3 mm to about 6 mm.

A cross-section of the intermediate unit may have a reverse arch-shape.

The fusing device may further include: a heat blocker disposed between the heat source and the pressurization unit to prevent transmission of heat from the heat source to the pressurization unit.

A reflection layer to reflect a radiant heat of the heat source may be provided on a surface of the heat blocker facing the heat source.

The fusing device may further include an elastic unit to apply a pressure to both ends of the pressurization unit.

Exemplary embodiments of the present inventive concept also provide an image forming device which includes: a printer to form an image on a print medium; and a fusing device to fix the image on the print medium, wherein the fusing device includes: at least one heat source to generate heat; a fusing belt disposed near the heat source; a rotation unit to contact an outer circumference of the fusing belt, the rotation unit including a shaft and an elastic layer coupled to an outer circumference of the shaft; at least one pressurization unit to press toward the rotation unit such that a fusing nip is formed between the fusing belt and the rotation unit; and an intermediate unit disposed between the pressurization unit and the heat conductor to prevent transmission of heat from the heat conductor to the pressurization unit, wherein a difference in height CRN_M between a central part of the intermediate unit and each of both ends of the intermediate unit satisfies the following equation: $\delta 1+\delta 2 \leq CRN_M \leq \delta 1+\delta 2+CRN_R$ wherein $\delta 1$ represents a flexural level of each of both ends of the pressurization unit, when a pressure is applied to the pressurization unit; $\delta 2$ represents a flexural level of each of both ends of the rotation unit, when a pressure is applied to the pressurization unit; and CRN_R represents R2−R1 indicating a difference between a distance R1 between a rotation center of the shaft and a central part of the elastic layer, and a distance R2 between the rotation center of the shaft and each of both ends of the elastic layer.

A cross-sectional profile of the intermediate unit in a width direction of the intermediate unit may be a parabola shape.

A cross-sectional profile of the elastic layer disposed near the fusing nip in a width direction of the rotation unit may be a parabola shape.

The fusing device may include: a heat blocker to cover the pressurization unit to prevent transmission of heat from the heat source to the pressurization unit; and a heat conductor disposed between the intermediate unit and an inner circumference of the fusing belt.

The heat conductor may have a reverse-arch shaped cross-section.

Exemplary embodiments of the present inventive concept also provide a fusing device comprising: at least one heat source to generate heat; a fusing belt surrounding the heat source; a rotation unit to contact an outer circumference of the fusing belt and having a reverse crown shape; at least one pressurization unit to press the fusing belt toward the rotation unit such that a fusing nip is formed between the fusing belt and the rotation unit; a heat conductor contacting an inner surface of the fusing belt to conduct heat to the fusing nip; and an intermediate unit disposed between the pressurization unit and the heat conductor to prevent transmission of heat from the heat conductor to the pressurization unit, the intermediate unit having a crown shape contacting a lower part of the pressurization unit to offset deterioration in width uniformity of the fusing nip due to flexural deformation of the pressurization unit and the rotation unit.

In an exemplary embodiment, the pressurization unit includes a first pressurization part having an arch-shaped cross-section and a second pressurization part having a reverse arch-shaped cross-section, the first pressurization part being coupled to the second pressurization part such that at least a part of the first pressurization part is present inside the second pressurization part.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
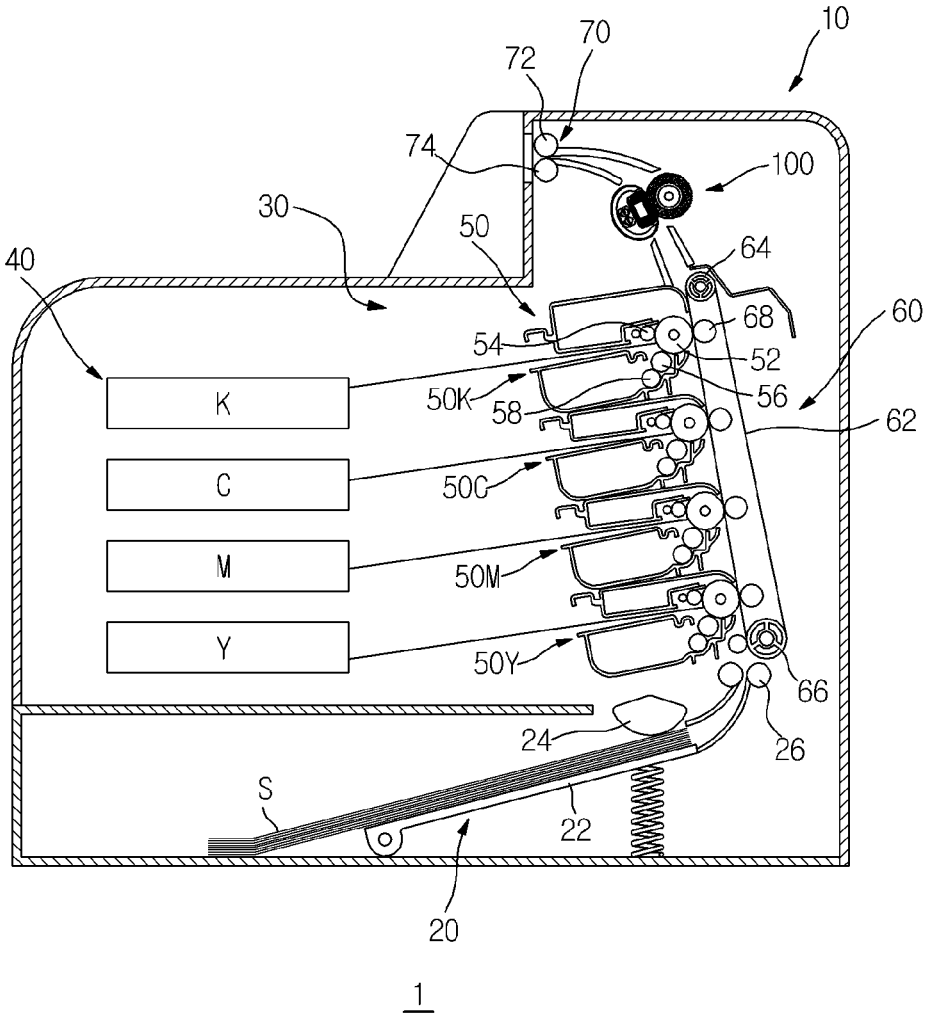
FIG. 1 illustrates a configuration of an image forming device according to an embodiment of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 illustrates a configuration of an image forming device according to an embodiment of the present inventive concept.

As shown in FIG. 1, the image forming device 1 includes a body 10, a print medium feeder 20, a printer 30, a fusing device 100 and a print medium discharger 70.

The body 10 forms an appearance of the image forming device and supports various components mounted therein. The body 10 includes a cover (not shown) to enable a part thereof to open and close and a body frame (not shown) to support or fix various components in the body 10.

The print medium feeder 20 supplies a plurality of print media S to the printer 30. The print medium feeder 20 includes a tray 22 on which the print media S are loaded, and a pick-up roller 24 to pick-up the print media loaded on the tray 22 one by one. The print media picked-up by the pick-up roller 24 are transported to the printer 30 through a transport roller 26.

The printer 30 includes a light irradiator 40, a developer 50, and a transfer unit 60.

The light irradiator 40 includes an optical system (not shown) and irradiates light corresponding to yellow (Y), magenta (M), cyan (C) and black (K) colors of image information to the developer 50 according to a printing signal.

The developer 50 forms a toner image according to image information input from an exterior apparatus such as a computer. The image forming device 1 according to the present embodiment is a color image forming device and the developer 50 includes four developers 50Y, 50M, 50C and 50K containing different colors of toners, for example, yellow (Y), magenta (M), cyan (C) and black (K) toners, respectively.

Each developer 50Y, 50M, 50C or 50K includes a photosensitive material 52 in which an electrostatic latent image is formed on the surface thereof by the light irradiator 40, a charging roller 54 to charge the photosensitive material 52, a development roller 56 to supply a toner image to the electrostatic latent image formed on the photosensitive material 52, and a supply roller 58 to supply a toner to the development roller 56.

The transfer unit 60 transfers the toner image formed on the photosensitive material 52 to a print medium. The transfer unit 60 includes a transfer belt 62 cyclically driving while contacting each photosensitive material 52, a transfer belt driving roller 64 to drive the transfer belt 62, a tension roller 66 to maintain a tension of the transfer belt 62, and four transfer rollers to transfer a toner image developed on the photosensitive material 52 to the print medium.

The print medium is adhered to the transfer belt 62 and is transported at the same speed as a driving speed of the transfer belt 62. At this time, a voltage having a polarity which is the opposite to that of the toner adhered to each photosensitive material 52 is applied to each transfer roller 68 and the toner image present on the photosensitive material 52 is then transferred to the print medium due to the electrical charges.

The fusing device 100 fixes the toner image transferred to the print medium through the transfer unit 60. A detailed description of the fusing device 100 will be provided as follows.

Meanwhile, the print medium discharger 70 discharges the print medium to the outside of the body 10. The print medium discharger 70 includes a discharge roller 72 and a pinch roller 74 facing the discharge roller 72.

Figure 2:
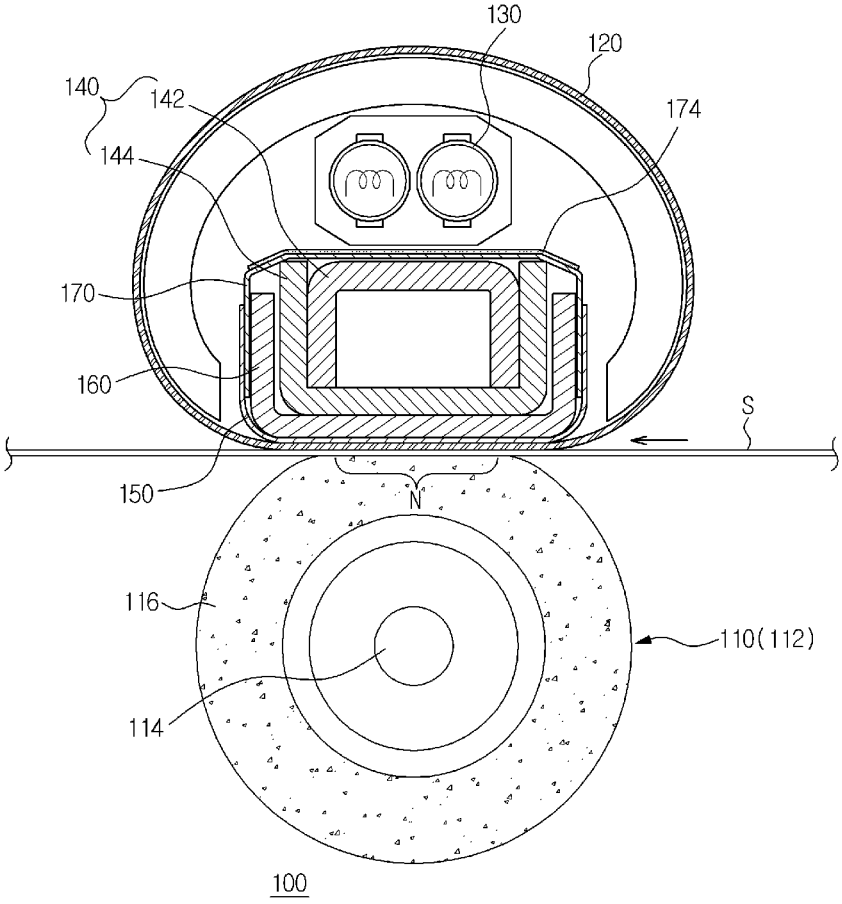
FIG. 2 is a sectional view illustrating a configuration of a fusing device according to an embodiment of the present inventive concept.
Figure 3:
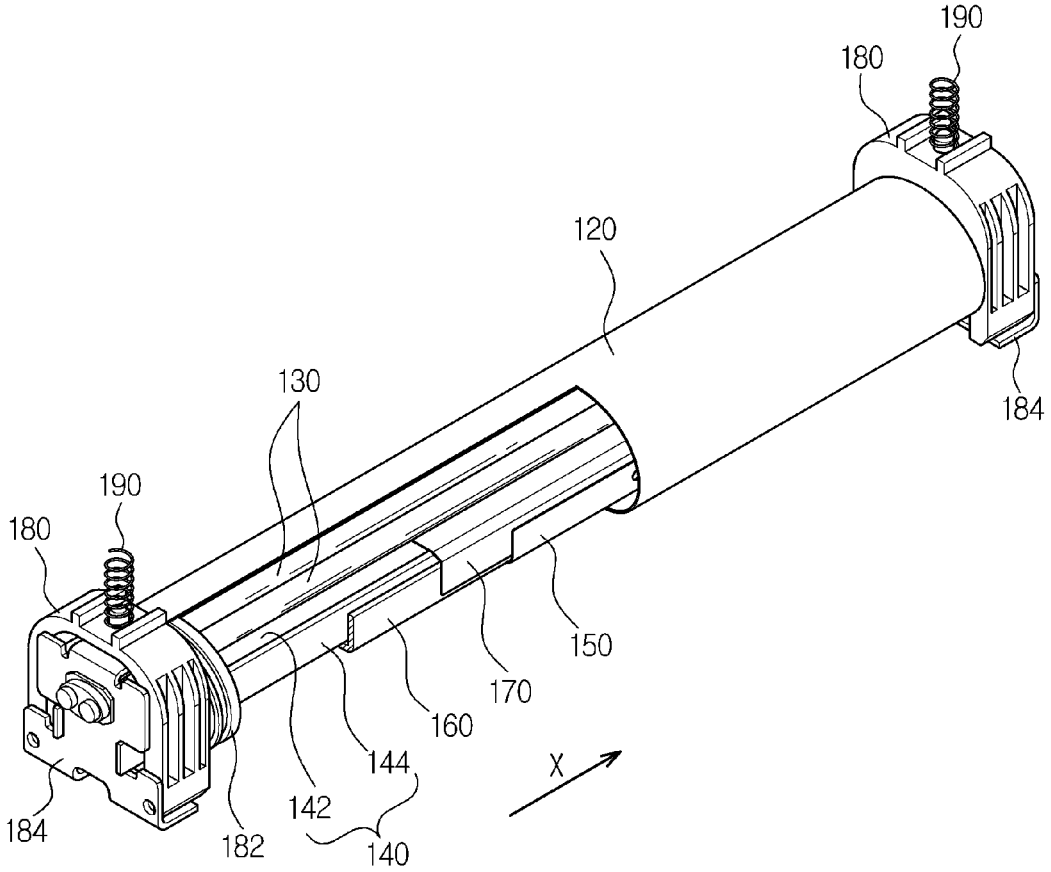
FIG. 3 is a combined perspective view illustrating a configuration of a fusing device according to an embodiment of the present inventive concept.
Figure 4:
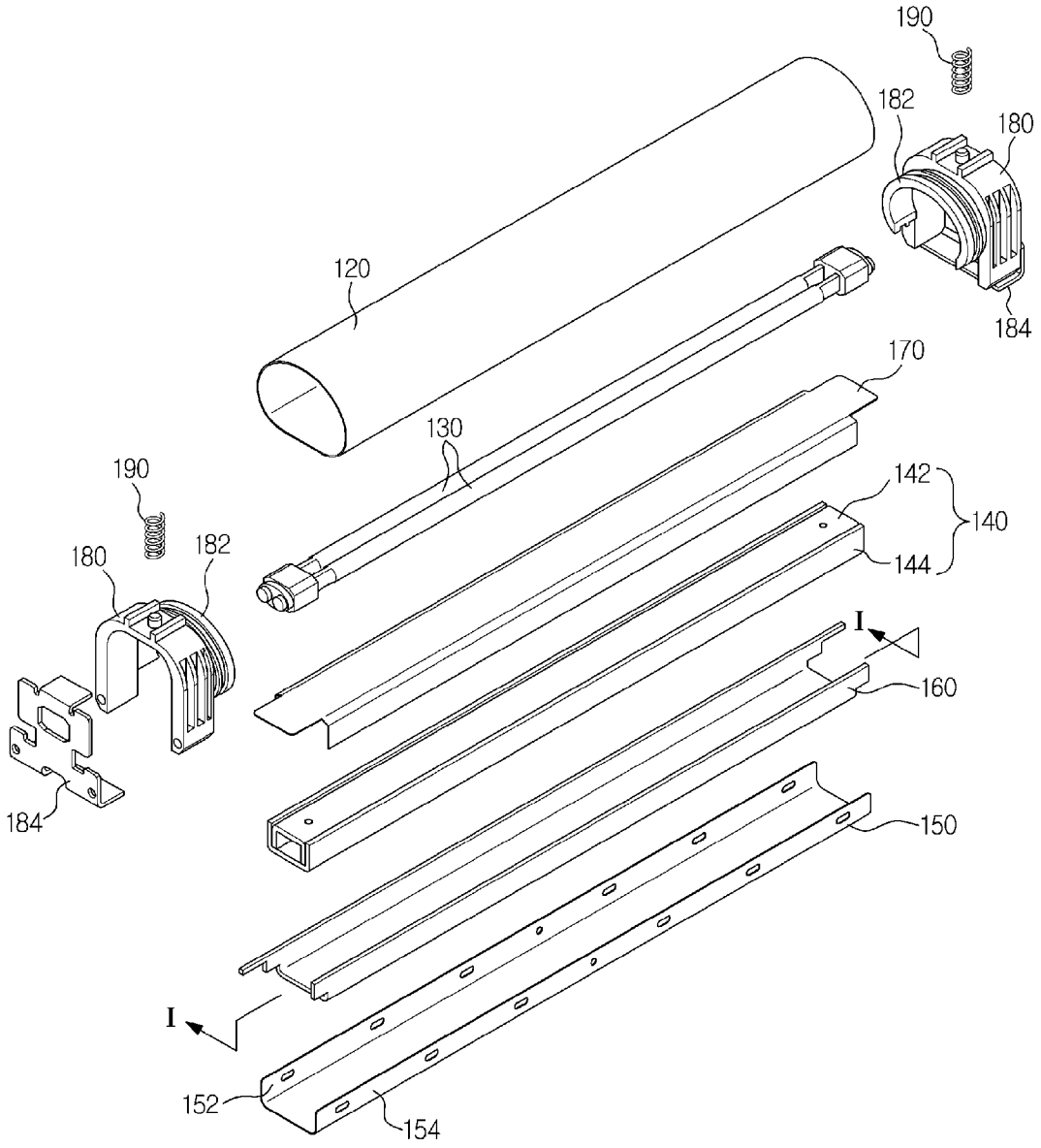
FIG. 4 is an exploded perspective view illustrating a configuration of a fusing device according to an embodiment of the present inventive concept.

FIG. 2 is a sectional view illustrating a configuration of a fusing device according to an exemplary embodiment of the present inventive concept. FIG. 3 is a combined perspective view illustrating a configuration of the fusing device according to an embodiment of the present inventive concept. FIG. 4 is an exploded perspective view illustrating a configuration of the fusing device according to an embodiment of the present inventive concept. In FIGS. 3 and 4, a rotation unit is omitted.

Hereinafter, a width direction of a print medium S, a width direction of a rotation unit 110, a width direction of a pressurization unit 140 and a width direction of an intermediate unit 160 all indicate the same direction, i.e., X-axis direction.

As shown in FIGS. 2 to 4, the fusing device 100 includes a rotation unit 110, a fusing belt 120, a heat source 130, a pressurization unit 140, a heat conductor 150, an intermediate unit 160 and a heat blocker 170.

The toner image-transferred print medium S passes through the space between the rotation unit 110 and the fusing belt 120. At this time, through heat and pressure, the toner image is fixed on the print medium.

The rotation unit 110 is disposed such that it contacts an outer circumference of the fusing belt 120 and forms a fusing nip N between the rotation unit 110 and the fusing belt 120. The rotation unit 110 may include a fusing roller 112 which receives power from a driving source (not shown) and is rotated thereby.

The fusing roller 112 includes a shaft 114 made of a metal material such as aluminum or stainless steel, and an elastic layer 116 which is elastically deformed to form a fusing nip N between the fusing belt 120 and the fusing roller 112. The elastic layer 116 is generally made of a silicone rubber. In order to apply a high fusing pressure from the fusing nip N to the print medium S, the elastic layer 116 preferably has an ASKER-C hardness of about 50 to about 80 and a thickness of about 3 mm to about 6 mm. A release layer (not shown) to prevent attachment of the print medium to the fusing roller 112 may be provided on the surface of the elastic layer 116.

The fusing belt 120 rotates while interlocking with the fusing roller 112, forms a fusing nip N together with the fusing roller 112, is heated through the heat source 130 and transports heat to the print medium S passing through the fusing nip N. The fusing belt 120 may be a mono-layer made of a metal or a heat-resistant polymer, or a di-layer including a base layer made of metal, heat-resistant polymer or the like and a protective layer stacked thereon. The inner surface of the fusing belt 120 may be colored with black or coated in order to facilitate heat absorption.

The heat source 130 is disposed to directly heat, by radiation, at least part of the inner circumference of the fusing belt 120. In order to improve fusing performance, the heat source 130 may include at least two heat sources 130. The heat source 130 may be a halogen lamp and may be realized with a variety of elements such as an electric heating wire or sheet-type heating element.

Support units 180 are disposed at both sides of the fusing belt 120. The support units 180 support components constituting the fusing device 100. The fusing belt 120 may be rotatably supported by the support units 180. Each support unit 180 includes a belt support 182 that protrudes toward the fusing belt 120 and supports an end of the fusing belt 120.

The support unit 180 is pressed toward the rotation unit 110 by an elastic unit 190. One end of the elastic unit 190 is supported by an upper part of the support unit 180 and the other end thereof is supported by a separate frame.

A holder 184 is coupled to the support unit 180. The holder 184 is disposed outside the support unit 180 and supports an end of the heat source 130 and an end of the pressurization unit 140. Pressure applied to the support unit 180 is transmitted through the holder 184 to the pressurization unit 140 and as a result, the pressurization unit 140 is pressed toward the rotation unit 110.

The pressurization unit 140 applies a pressure to an inner circumference of the fusing belt 120 to form a fusing nip N between the fusing belt 120 and the rotation unit 110. The pressurization unit 140 may be made of a material having a high strength such as stainless steel or carbon steel.

When the hardness of the pressurization unit 140 is low, flexural deformation greatly occurs and uniform pressurization of the fusing nip N is thus impossible. Accordingly, the pressurization unit 140 includes a first pressurization unit 142 having an arch-shaped cross-section and a second pressurization unit 144 having a reverse arch-shaped cross-section, and the first pressurization unit 142 is coupled to the second pressurization unit 144 such that at least part of the first pressurization unit 142 is present inside the second pressurization unit 144. The pressurization unit 140 may be an arch- or reverse arch-shaped pressurization unit and may have a structure having a high cross-sectional inertia moment such as an I-beam or H-beam.

The heat conductor 150 contacts an inner circumference of the fusing belt 120 to conduct heat to the fusing nip N. The heat conductor 150 has a reverse arch-shaped cross-section and is connected through both sides 152 and 154 thereof to the heat blocker 170 (see FIG. 4). The heat of the heat blocker 170 is transmitted to the heat conductor 150 and is used to heat the fusing belt 120.

An intermediate unit 160 is disposed between the heat conductor 150 and the pressurization unit 140. The intermediate unit 160 has a reverse arch-shaped cross-section, and spaces the heat conductor 150 from the pressurization unit 140 to prevent transmission of heat from the heat conductor 150 to the pressurization unit 140. The intermediate unit 160 is made of a material having low thermal conductivity and heat resistance. The intermediate unit 160 may be made of a material having lower thermal conductivity than that of the heat conductor 150. For example, the intermediate unit 160 is made of a material including a heat resistant resin or a ceramic such as polyether ether ketone (PEEK) or a liquid crystal polymer (LCP).

When the radiant heat of the heat source 130 directly heats the pressurization unit 140, the pressurization unit 140 is heated to a high temperature and is thus thermally-deformed, and uniform pressurization of the fusing nip N by the pressurization unit 140 becomes impossible. In addition, when a considerable amount of heat emitted from the heat source 130 is used to heat the pressurization unit 140, temperature elevation performance of the fusing device 100 becomes deteriorated.

Accordingly, the fusing device 100 includes a heat blocker 170 disposed between the heat source 130 and the pressurization unit 140. The heat blocker 170 is disposed to surround at least part of the pressurization unit 140, in particular, an upper part of the pressurization unit 140 facing the heat source 130, blocks heat directly irradiated to the pressurization unit 140, and thereby prevents thermal deformation of the pressurization unit 140 due to a considerable amount of heat emitted from the heat source 130.

The heat blocker 170 may include a reflection layer 174 to reflect heat of the heat source 130. The reflection layer 174 may be provided on the surface of the heat blocker 170 facing the heat source 130. The reflection layer 174 may be formed by coating the heat blocker 170 with a reflective material such as silver. When the reflection layer 174 is formed on the heat blocker 170, heat radiated to the heat blocker 170 is reflected toward the fusing belt 120 by the reflection layer 174, and heating of the fusing belt 120 is thus facilitated.

The heat blocker 170 is made of a material having high thermal conductivity. The heat blocker 170 may be provided with a material having a higher thermal conductivity than that the pressurization unit 140. For example, the heat blocker 170 may be provided with aluminum, copper or an alloy thereof.

Figure 5:
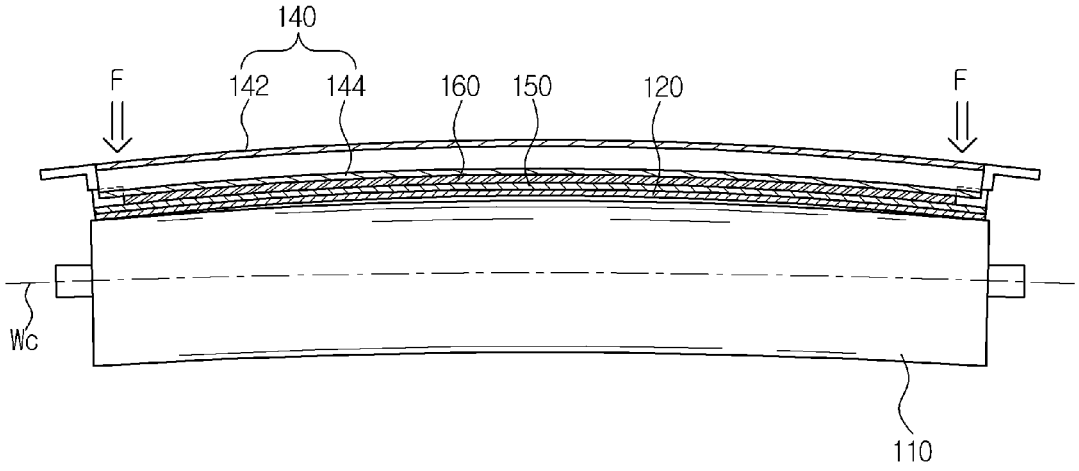
FIG. 5 is a longitudinal sectional view illustrating a part of the configuration shown in FIG. 3.
Figure 6:
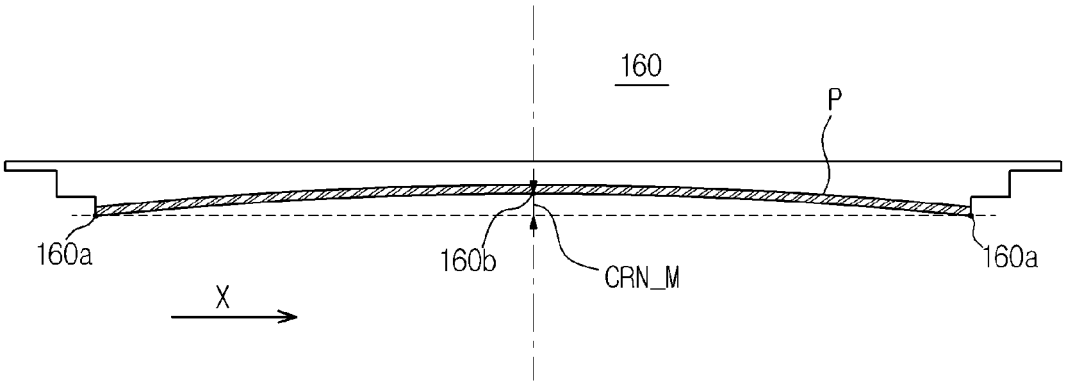
FIG. 6 is a sectional view taken along the line I-I of the configuration shown in FIG. 4, which illustrates a profile of a cross-section of the intermediate unit.
Figure 7:
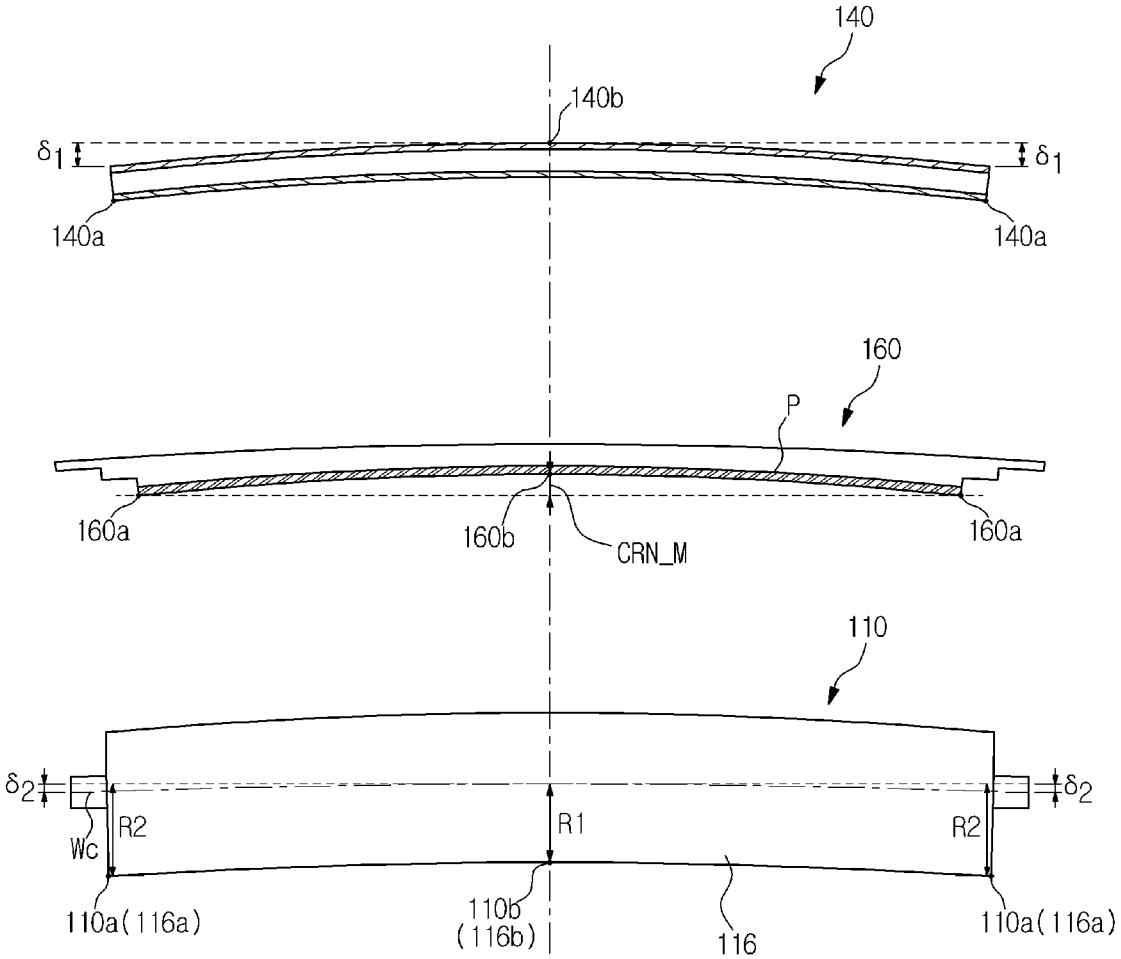
FIG. 7 an exploded view illustrating the pressurization unit, the intermediate unit and the rotation unit shown in FIG. 5, which illustrates a relation between a crown level of the intermediate unit, flexural levels of both ends of the pressurization unit and the rotation unit, and a reverse-crown level of the rotation unit.

FIG. 5 is a longitudinal sectional view illustrating a part of the configuration shown in FIG. 3, and FIG. 6 is a sectional view taken along the line I-I of the configuration shown in FIG. 4, which illustrates a cross-sectional profile of the intermediate unit. FIG. 7 an exploded view illustrating a pressurization unit, the intermediate unit and a rotation unit of FIG. 5, which illustrates a relation between a crown level of the intermediate unit, flexural levels of both ends of the pressurization unit and the rotation unit, and a reverse-crown level of the rotation unit.

As shown in FIGS. 5 to 7, the elastic unit 190 pressurizes both ends of the support unit 180 toward the rotation unit 110 and a pressure F applied to the support unit 180 is transmitted through the holder 184 to both ends 140*a* of the pressurization unit 140.

The both ends 140*a* of the pressurization unit 140 receive a pressure higher than that of a center 140*b* thereof and the pressurization unit 140 is flexurally deformed in a width direction X thereof. The pressure applied to the both ends 140*a* of the pressurization unit 140 is transmitted to the both ends 110*a* of the rotation unit 110 and the rotation unit 110 is flexurally deformed in a width direction X thereof.

In addition, in order to prevent deformation of the print medium S by heat and pressure applied while passing through the fusing nip N, the rotation unit 110 has a reverse-crown shape in which a distance R2 between a rotation center Wc of the rotation unit 110 and the end 110*a* of the rotation unit 110 is greater than a distance R1 between the rotation center Wc of the rotation unit 110 and a central part 110*b* of the rotation unit 110.

The flexural deformation of the pressurization unit 140 and the rotation unit 110 and the reverse crown shape of the rotation unit 110 may directly affect a width of the fusing nip N. When the width of the fusing nip N is not uniform during fusing, major factors determining image quality, i.e., gloss and gloss uniformity may be deteriorated.

Accordingly, the intermediate unit 160 has a shape, offsetting effects of flexural deformation of the pressurization unit 140 and the rotation unit 110 and the reverse crown shape of the rotation unit 110 in order to keep the width of the fusing nip N uniform.

As shown in FIG. 6, a cross-sectional profile P of the intermediate unit 160 in a width direction X of the intermediate unit 160 is provided in a parabola shape which is curved toward the pressurization unit 140 (hereinafter, referred to as a "crown" shape).

As described above, by forming, in the crown shape, the cross-sectional profile P of the intermediate unit 160 contacting the pressurization unit 140 in a lower part of the pressurization unit 140, deterioration in width uniformity of the fusing nip N caused by flexural deformation of the pressurization unit 140 and the rotation unit 110, and the reverse-crown shape of the rotation unit 110 is offset.

The crown level CRN_M of the cross-sectional profile P of the intermediate unit 160, that is, a difference in height between the central part 160*b* of the intermediate unit and the ends 160*a* of the intermediate unit, is set to satisfy the following equation.

$$\delta 1+\delta 2 \leq CRN_M \leq \delta 1+\delta 2+CRN_R$$

wherein δ1 represents a flexural level of the ends 140*a* of the pressurization unit 140 according to flexural deformation of the pressurization unit 140 in a width (x) direction of the pressurization unit, when the pressurization unit 140 is pressurized by the elastic unit 190, and δ2 represents a flexural level of the ends 110*a* of the rotation unit 110 according to flexural deformation of the rotation unit 110 in a width (x) direction of the rotation unit 110, when the pressurization unit 140 is pressurized by the elastic unit 190.

In addition, CRN_R means a reverse-crown level of the rotation unit 110, that is, a difference (R2−R1) between the distance R1 between the rotation center Wc of the rotation unit 110 and the central part 110*b* of the rotation unit 110, and the distance R2 between the rotation center Wc of the rotation unit 110 and the end 110*a* of the rotation unit 110.

The rotation unit 110 has a reverse-crown shape, because the elastic layer 116 constituting the rotation unit 110 has a reverse-crown shape. Accordingly, the distance R1 between the rotational center Wc of the rotation unit 110 and the central part 110*b* of the rotation unit 110 is equivalent to the distance between the rotational center Wc of the rotation unit 110 and the central part 116*b* of the elastic layer 116, and the distance R2 between the rotation center Wc of the rotation unit 110 and the end 110*a* of the rotation unit 110 is equivalent to the distance between the rotation center Wc of the rotation unit 110 and the end 116*a* of the elastic layer 116.

When the crown level CRN_M of the cross-sectional profile P of the intermediate unit 160 satisfies the equation above, flexural deformation of the pressurization unit 140 and the rotation unit 110, and the reverse-crown shape of the rotation unit 110 offset deterioration in width uniformity of the fusing nip N and keep the width of the fusing nip N uniform during fusing.

Figure 8A:
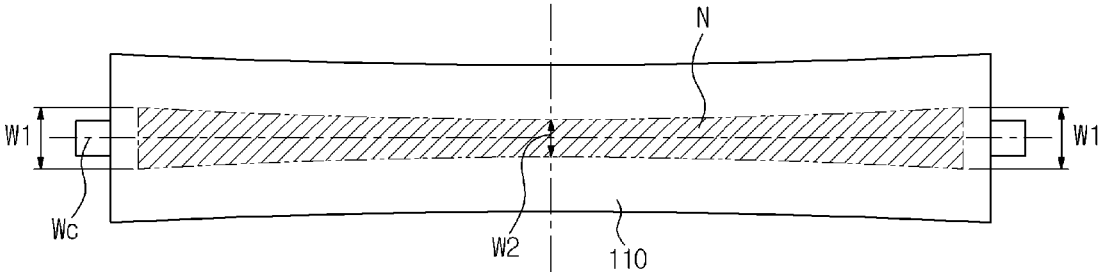
FIGS. 8A to 8C illustrate variation in the width of the fusing nip under control of a crown level of the intermediate unit.

When the crown level CRN_M of the cross-sectional profile P of the intermediate unit 160 is lower than a sum of a flexural level (δ1) of the end 110*a* of the pressurization unit 140 and a flexural level (δ2) of the end 110*a* of the rotation unit 110, as shown in FIG. 8A, a width W2 of the central part of the fusing nip N is smaller than a width W1 of the end of the fusing nip N.

Figure 8B:
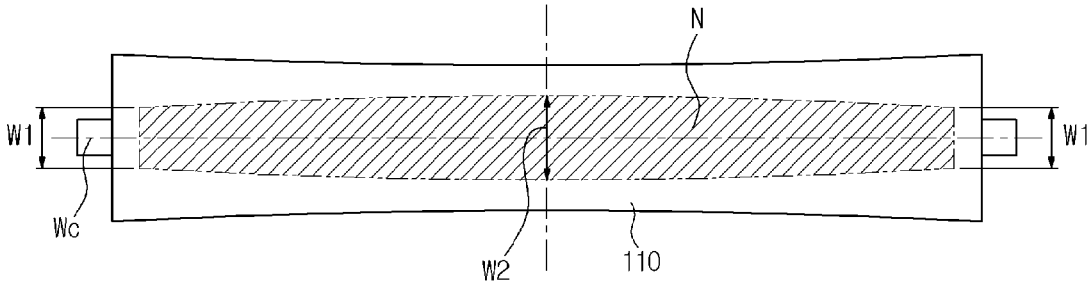

In addition, when the crown level CRN_M of the cross-sectional profile P of the intermediate unit 160 is greater than a sum of the flexural level (δ1) of the end 110*a* of the pressurization unit 140 and the flexural level (δ2) of the end 110*a* of the rotation unit 110, as shown in FIG. 8B, the width W1 of the end of the fusing nip N is smaller than the width W2 of the central part of the fusing nip N.

In these two cases, gloss of the print medium S is deteriorated, gloss uniformity in the width (x) direction of the print medium S is deteriorated and acquisition of an image with high quality is thus impossible.

Figure 8C:
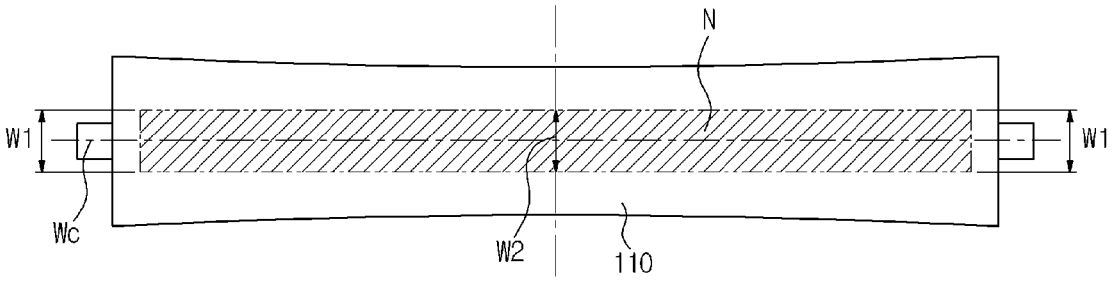

When the crown level CRN_M of the cross-sectional profile P of the intermediate unit 160 is equivalent to or greater than a sum of the flexural level (δ1) of the end 110*a* of the pressurization unit 140 and the flexural level (δ2) of the end 110*a* of the rotation unit 110, or is equivalent to or smaller than a sum of the flexural level (δ1) of the end 110*a* of the pressurization unit 140, the flexural level (δ2) of the end 110*a* of the rotation unit 110 and a reverse-crown level (CRN_R) of the rotation unit 110, as shown in FIG. 8C, widths W1 and W2 of the fusing nip N in the width direction X of the print medium S are uniformly maintained, and acquisition of gloss and gloss uniformity is thus possible.

Figure 9:
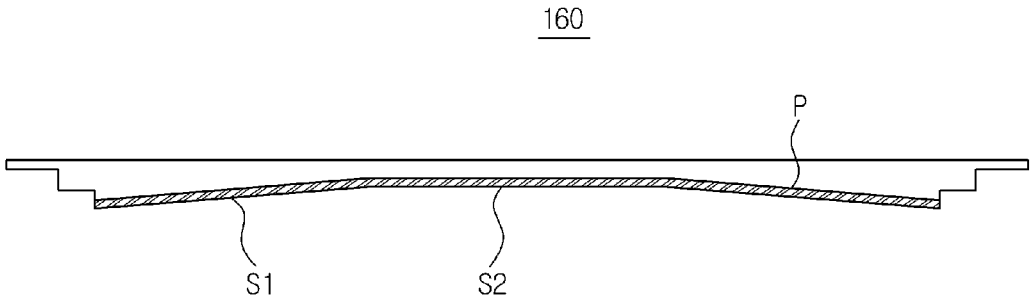
FIG. 9 illustrates a cross-sectional profile of the intermediate unit according to a modified embodiment of the present inventive concept.

Meanwhile, as shown in FIG. 9, the cross-sectional profile P of the intermediate unit 160 may be provided in a trapezoidal shape including an inclined portion S1 and a straight line portion S2, and the trapezoidal shape exhibits the same effect as the curved parabola shape.

As apparent from the fore-going, by suitably setting the cross-sectional profile of the intermediate unit 160, flexural levels of the pressurization unit 140 and the rotation unit 110 by a pressure applied to both ends of the pressurization unit 140 and the reverse-crown level of the rotation unit near the fusing nip are offset, and a width of the fusing nip is uniformly maintained and acquisition of gloss and gloss uniformity is thus possible.

In addition, acquisition of an image with high quality is possible.

Although a few embodiments of the present inventive concept have been shown and described, it will be appreciated by those skilled in the art that changes may be made in these embodiments without departing from the principles and spirit of the inventive concept, the scope of which is defined in the claims and their equivalents.

What is claimed is:

1. A fusing device comprising:

at least one heat source to generate heat;

a fusing belt disposed near the heat source;

a rotation unit contacting an outer circumference of the fusing belt;

at least one pressurization unit to press toward the rotation unit such that a fusing nip is formed between the fusing belt and the rotation unit;

a heat conductor contacting an inner surface of the fusing belt to conduct heat to the fusing nip; and an intermediate unit disposed between the pressurization unit and the heat conductor to prevent transmission of heat from the heat conductor to the pressurization unit, wherein a difference in height CRN_M between a central part of the intermediate unit and each of both ends of the intermediate unit satisfies the following equation:

$$\delta 1+\delta 2 \leq CRN_M \leq \delta 1+\delta 2+CRN_R$$

wherein δ1 represents a flexural level of each of both ends of the pressurization unit, when a pressure is applied to the pressurization unit;

δ2 represents a flexural level of each of both ends of the rotation unit, when a pressure is applied to the pressurization unit; and CRN_R represents R2−R1 indicating a difference between a distance R1 between the rotation center of the rotation unit and the central part of the rotation unit, and a distance R2 between the rotation center of the rotation unit and the end of the rotation unit.

2. The fusing device according to claim 1, wherein a cross-sectional profile of the intermediate unit in a width direction of the intermediate unit is curved toward the pressurization unit.

3. The fusing device according to claim 1, wherein the pressurization unit comprises:

a first pressurization unit having an arch-shaped cross-section; and a second pressurization unit having a reverse arch-shaped cross-section.

4. The fusing device according to claim 1, wherein at least part of the first pressurization unit is present inside the second pressurization unit.

5. The fusing device according to claim 1, wherein the rotation unit comprises:

a rotatably disposed shaft; and an elastic layer coupled to an outer circumference of the shaft, the elastic layer having an elasticity enabling formation of the fusing nip, when a pressure is applied to the pressurization unit.

6. The fusing device according to claim 5, wherein the elastic layer has an ASKER-C hardness of about 50 to about 80.

7. The fusing device according to claim 5, wherein the elastic layer has a thickness of about 3 mm to about 6 mm.

8. The fusing device according to claim 1, wherein a cross-section of the intermediate unit has a reverse arch-shape.

9. The fusing device according to claim 1, further comprising:

a heat blocker disposed between the heat source and the pressurization unit to prevent transmission of heat from the heat source to the pressurization unit.

10. The fusing device according to claim 9, wherein a reflection layer to reflect a radiant heat of the heat source is provided on a surface of the heat blocker facing the heat source.

11. The fusing device according to claim 1, further comprising an elastic unit to pressurize both ends of the pressurization unit.

12. An image forming device comprising:

a printer to form an image on a print medium; and a fusing device to fix the image on the print medium, wherein the fusing device comprises:

at least one heat source to generate heat;

a fusing belt disposed near the heat source;

a rotation unit contacting an outer circumference of the fusing belt, the rotation unit comprising a shaft and an elastic layer coupled to an outer circumference of the shaft;

at least one pressurization unit pressed toward the rotation unit such that a fusing nip is formed between the fusing belt and the rotation unit; and an intermediate unit disposed between the pressurization unit and the heat conductor to prevent transmission of heat from the heat conductor to the pressurization unit, wherein a difference in height CRN_M between a central part of the intermediate unit and each of both ends of the intermediate unit satisfies the following equation:

$$\delta 1+\delta 2 \leq CRN_M \leq \delta 1+\delta 2+CRN_R$$

wherein δ1 represents a flexural level of each of both ends of the pressurization unit, when a pressure is applied to the pressurization unit;

δ2 represents a flexural level of each of both ends of the rotation unit, when a pressure is applied to the pressurization unit; and CRN_R represents R2−R1 indicating a difference between a distance R1 between a rotation center of the shaft and a central part of the elastic layer, and a distance R2 between the rotation center of the shaft and each of both ends of the elastic layer.

13. The image forming device according to claim 12, wherein a cross-sectional profile of the intermediate unit in a width direction of the intermediate unit is a parabola shape.

14. The image forming device according to claim 12, wherein a cross-sectional profile of the elastic layer disposed near the fusing nip in a width direction of the rotation unit is a parabola shape.

15. The image forming device according to claim 12, wherein the fusing device comprises:

a heat blocker covering the pressurization unit to prevent transmission of heat from the heat source to the pressurization unit; and a heat conductor disposed between the intermediate unit and an inner circumference of the fusing belt.

16. The image forming device according to claim 15, wherein the heat conductor has a reverse-arch shaped cross-section.

17. A fusing device comprising:

at least one heat source to generate heat;

a fusing belt surrounding the heat source;

a rotation unit to contact an outer circumference of the fusing belt and having a reverse crown shape;

at least one pressurization unit to press the fusing belt toward the rotation unit such that a fusing nip is formed between the fusing belt and the rotation unit;

a heat conductor contacting an inner surface of the fusing belt to conduct heat to the fusing nip; and an intermediate unit disposed between the pressurization unit and the heat conductor to prevent transmission of heat from the heat conductor to the pressurization unit, the intermediate unit having a crown shape contacting a lower part of the pressurization unit to offset deterioration in width uniformity of the fusing nip due to flexural deformation of the pressurization unit and the rotation unit.

18. The fusing device of claim 17, wherein the pressurization unit includes a first pressurization part having an arch-shaped cross-section and a second pressurization part having a reverse arch-shaped cross-section, the first pressurization part being coupled to the second pressurization part such that at least a part of the first pressurization part is present inside the second pressurization part.

* * * * *